US008803017B2

(12) United States Patent
Huang

(10) Patent No.: US 8,803,017 B2
(45) Date of Patent: Aug. 12, 2014

(54) PUSH BUTTON SWITCH

(76) Inventor: Yu-Sung Huang, Bade (TW)

( * ) Notice: Subject to any disclaimer, the term of this patent is extended or adjusted under 35 U.S.C. 154(b) by 208 days.

(21) Appl. No.: 13/542,842

(22) Filed: Jul. 6, 2012

(65) Prior Publication Data

US 2014/0008198 A1 Jan. 9, 2014

(51) Int. Cl.
*H01H 19/62* (2006.01)

(52) U.S. Cl.
USPC ..... 200/527; 200/529

(58) Field of Classification Search
USPC ..... 200/520, 526–529
See application file for complete search history.

(56) References Cited

U.S. PATENT DOCUMENTS 6,396,015 B1 * 5/2002 Ko ..... 200/529
6,621,028 B1 * 9/2003 Bartok ..... 200/529
6,809,281 B2 * 10/2004 Miki ..... 200/529

* cited by examiner

*Primary Examiner* — Renee S Luebke
*Assistant Examiner* — Lheiren Mae Caroc
(74) *Attorney, Agent, or Firm* — Rosenberg, Klein & Lee

(57) ABSTRACT

A push-button switch comprises a lower housing, an upper housing, four terminals, a spring, a driven wheel, and a driving wheel. The terminals are integrally molded with the upper housing and only the contact portions thereof are exposed, such that the movable contacts of an annular conductive plate face upward and remain hovering for the annular conductive plate rotating smoothly before the annular conductive plate contacts with the terminals in order to avoid a deformation and an impact damage between the terminals and the tactics contacts.

6 Claims, 6 Drawing Sheets

PUSH BUTTON SWITCH

BACKGROUND OF THE INVENTION

1. Field of the Invention

The invention relates to a push button switch, and more particularly to the switch having terminals integrally molded with an upper housing and only the contact portions thereof are exposed, such that the movable contacts of the annular conductive plate face upward and remain hovering for the annular conductive plate rotating smoothly before contacting with the terminals.

2. Description of the Related Art

Nowadays, a variety of electronic and electrical products are greatly used in daily life or in the workplace. A push button switch is very common in the use of the components and accessories of electrical and electronic products for conducting or cutting off the circuit connection.

Switches of these types are well known in the art and examples thereof may be found in U.S. Pat. Nos. 5,586,645, 5,266,529, 4,906,808, 4,319,106, and 4,175,222, the disclosures of which are incorporated herein by reference.

Disclose in the prior art patents are simple push-button switches of the type adapted to sequentially open and close a circuit or to sequentially switch power between two alternate circuits, there are known to those of skill in the art a variety of other configurations adapted for similar function.

With reference to the structures of the conventional push-button switch, a plurality of terminals are arranged in a lower housing, and a contact plate is arranged under a spring and stepping moans. The kind of push-button switches have the following drawbacks:

1. In the conventional push-button switches, the contact plate is directly traveled down to the contact portions of the terminals, so it is easy to form an impact damage between the contact plate and the contact portions of the terminals in the rotation process, resulting in a poor rotation and deformation of the terminals and the contact plate and affecting the function of the push-button switches.

2. The outer margin of the conventional contact plate has several contact regions for contacting with the contact portions of the terminals, resulting in a poor strength of the contact regions and deformation and affecting an actuation function of the contact plate.

3. The external portion of the conventional terminals and the contact portions of the terminals are in the same plate. Therefore, when the deformation is formed by connecting the external portion of the terminals to an external component, the contact portions of the terminals are easily deformed, resulting in a poor connection or jamming between the contact plate and the terminals; accordingly, the contact plate is unable to rotate.

SUMMARY OF THE INVENTION

The present invention overcomes the disadvantages abovementioned as well as other disadvantages of the referred-to switch.

An object of the present invention is to provide a push button switch with a simple structure for an annular conductive plate rotating smoothly without deformation.

In order to achieve the above object, the invention includes: a lower housing having a circular recess in the middle thereof and a central post extending perpendicularly away from the center of the circular recess; an upper housing combining with the lower housing to form a housing body and having an axial hole on a top surface thereof, a plurality of position limiting lugs symmetrically arranged around the axial hole at an inner margin surface of the upper housing, and each of the position limiting lugs having a guide ramp with the same direction on a bottom margin thereof; a first terminal being an L-shaped body and having a transverse portion integrally molded with the upper housing and a vertical portion exposed at a right side of the upper housing, the transverse portion being a Y-shaped body and having a first static contact and a second static contact respectively arranged at the end of the Y-shaped transverse portion, and contact surfaces of the first and second static contact facing downward and exposed at the inner margin surface of the upper housing; a second terminal and third terminal being L-shaped bodies and having transverse portions integrally molded with the upper housing and vertical portions exposed at a left side of the upper housing, the transverse portions having a third static contact and a fourth static contact respectively arranged at the end thereof, and contact surfaces of the third static contact and the fourth static contact facing downward and exposed at the inner margin surface of the upper housing; such that, the first, second, third, and fourth static contacts are symmetrically exposed at the four end angles of the inner margin surface of the upper housing, and a distance between each of the static contacts is equal; a spring having a bottom end positioned on the central post of the lower housing; a driven wheel made of insulating materials, positioned on a top of the spring, and having a annular recess at a bottom surface thereof and a circular hole at a middle of a top surface thereof, the circular hole having a plurality of radial rib bodies to form an axial guide slot between each radial rib body for mounting on the position limiting lug of the upper housing, each of the radial rib bodies having a taper ramp thereon with the same direction, the annular recess having an annular conductive plate therein and the annular conductive plate being made of conducting materials and having a first movable contact and a second movable contact respectively arranged on a corresponding end of the annular conductive plate, and the first and second movable contact, corresponding to the first, second, third, and fourth static contacts are exposed at a top surface of the driven wheel; and a driving wheel having an actuator plunger and a plurality of actuator lugs at a bottom end of the actuator plunger, wherein the actuator plunger is upwardly extended through a bottom surface of the axial hole and exposed at a top surface of the upper housing, each of the actuator lugs corresponding to the radial rib body of the driven wheel is against a top of the taper ramp; whereby when the actuator plunger of the upper housing is fully depressed, the driven wheel traveling downward until the axial guide slot departs from the position limiting lug of the upper housing, and the actuator lug of the driving wheel urges the taper ramp of the radial rib body for the driven wheel rotating at an angle; when the actuator plunger of the upper housing is released, the driven wheel is urged upward by the spring and the radial rib body slides along the guide ramp of the position limiting lug of the upper housing into the adjacent position limiting lug for synchronously driving the first movable and second movable contact of the driven wheel into a 90° rotation; such that, one of the second terminal and third terminal is electrically connected to the first terminal in order to control the circuit connecting switch.

According to the features disclosed, the driven wheel has a notch at two corresponding ends thereof for the first movable contact and second movable contact of the driven wheel exposing at a surface of the driven wheel, and a locating recess at other two corresponding ends thereof for locating four static contacts of the upper housing; wherein two static contacts on the corresponding end locate on the locating recess and other two corresponding static contacts respectively form an electrical connection with the first movable contact and second movable contact.

Further, the upper housing has four position limiting lugs, and the driven wheel has four corresponding axial guide slots for the driven wheel being rotated once 90°. Further, the driving wheel has four actuator lugs.

Base on the features disclosed, the present invention has the following effects:

1. The first, second, and third terminal are 90° L-shaped bodies that the transverse portions and the vertical portions as contact portions are not in a same plate. Moreover, the transverse portions are integrally molded with the upper housing and only the first, second, third, and fourth static contact are exposed. Therefore, when the vertical portions of the terminals are deformed by connecting to an external component, the deformation of the terminals will not affect to the contact portions. Accordingly, the terminals remain a good electrical connection with the annular conductive plate.

2. The static contacts face downward, the movable contact face upward and the annular conductive plate travels downward with the driven wheel until departing from the position limiting lug and rotates at an angle in order to avoid the friction and impact damage between the terminals and the tactics contacts. Accordingly, the switch can rotate smoothly.

3. The annular conductive plate is fixed in the driven wheel in order to increase the strength of the annular conductive plate and to avoid deformation, ensuring its service life.

DETAILED DESCRIPTION OF THE PREFERRED EMBODIMENT

Figure 1A:
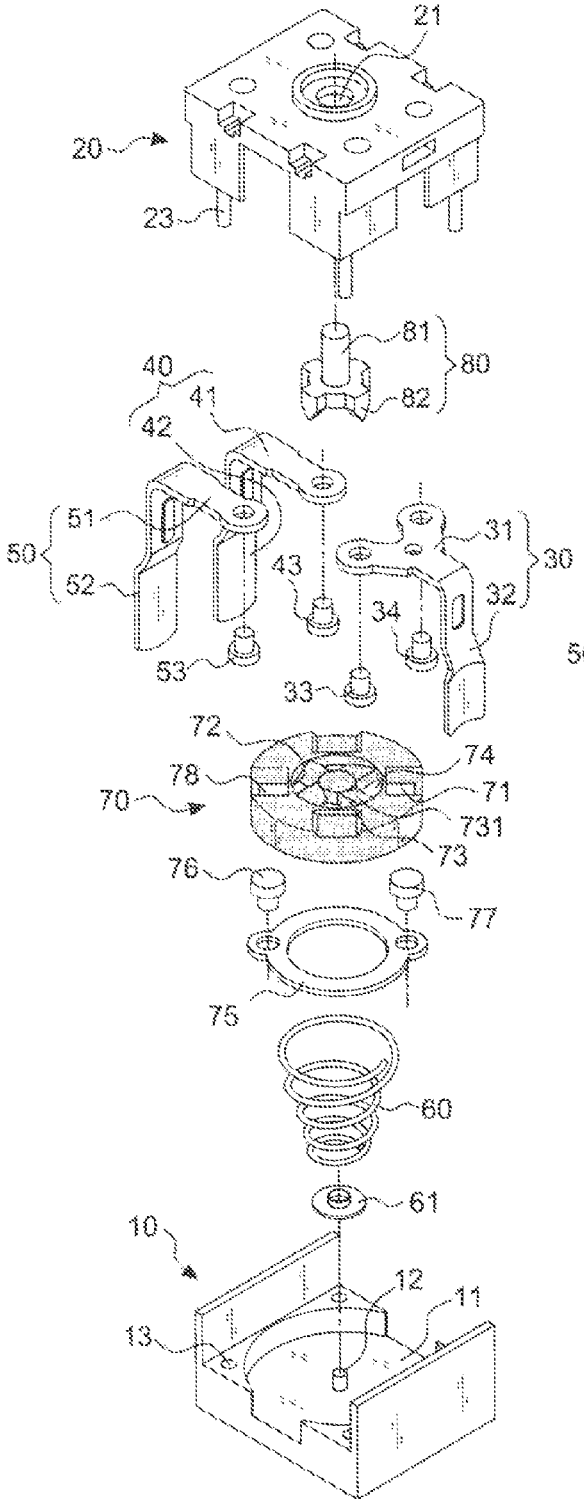
FIG. 1A is an exploded perspective view of all of the elements in accordance with the present invention.
Figure 1B:
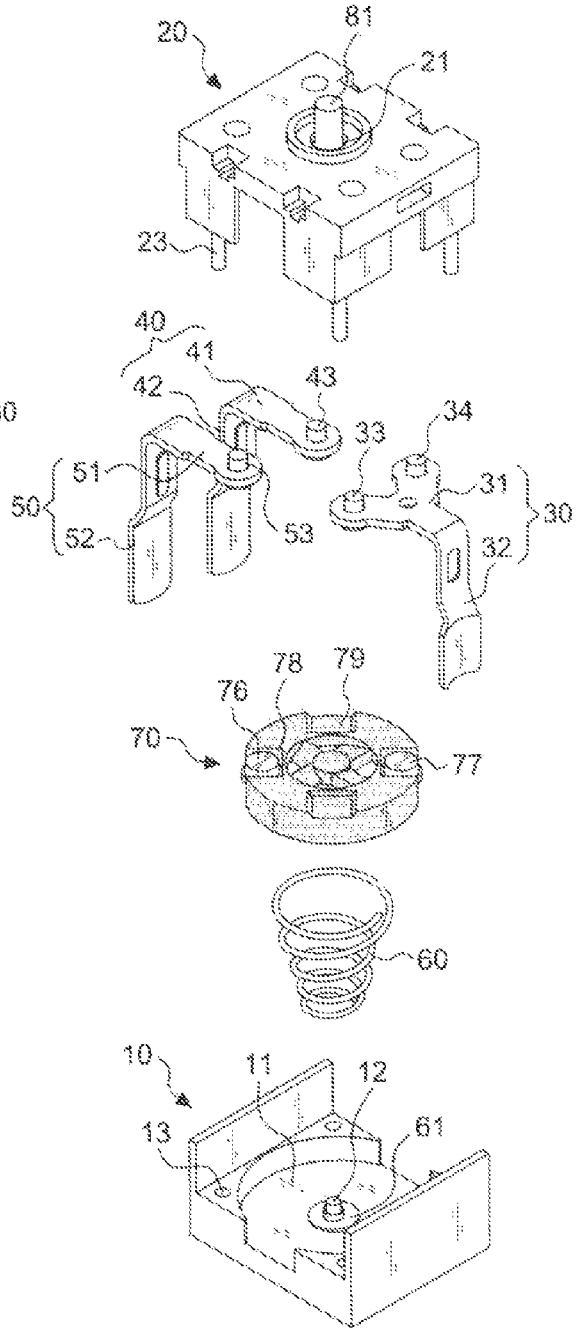
FIG. 1B is an exploded perspective view of part of the elements in accordance with the present invention.
Figure 2A:
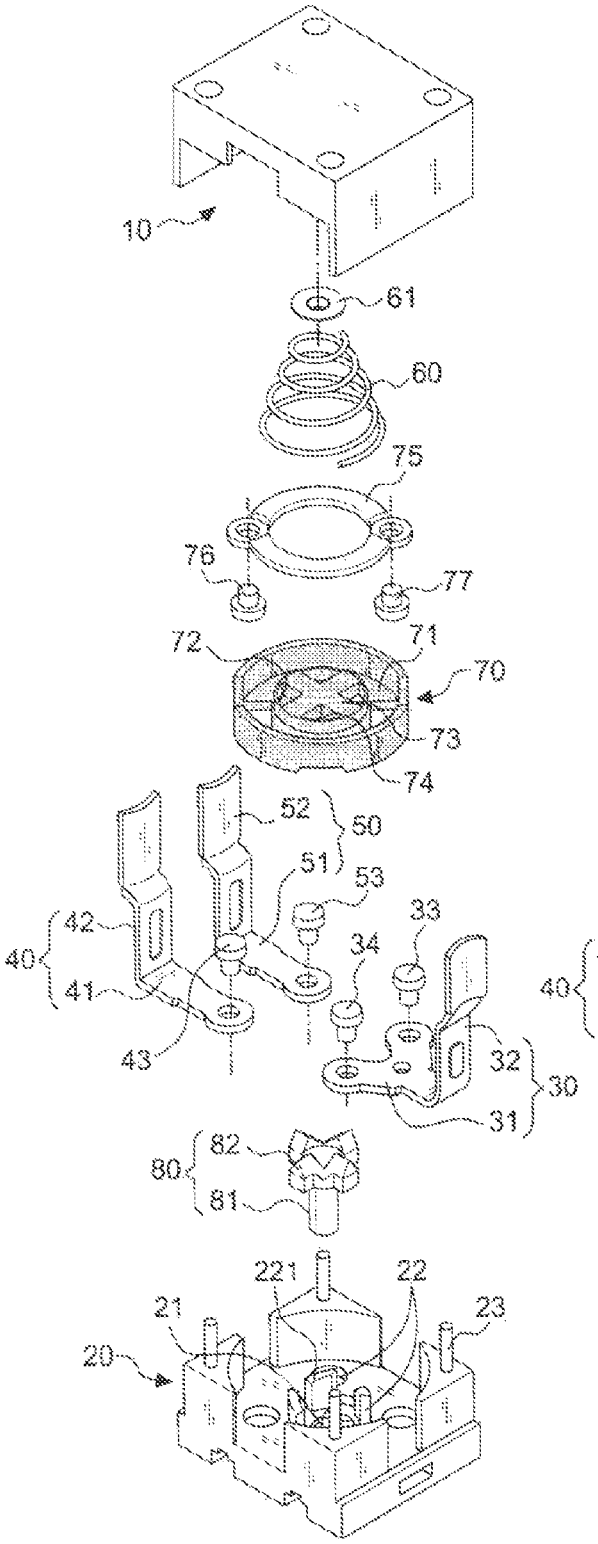
FIG. 2A is an exploded perspective view, illustrating the opposite angle of FIG. 1A.
Figure 2B:
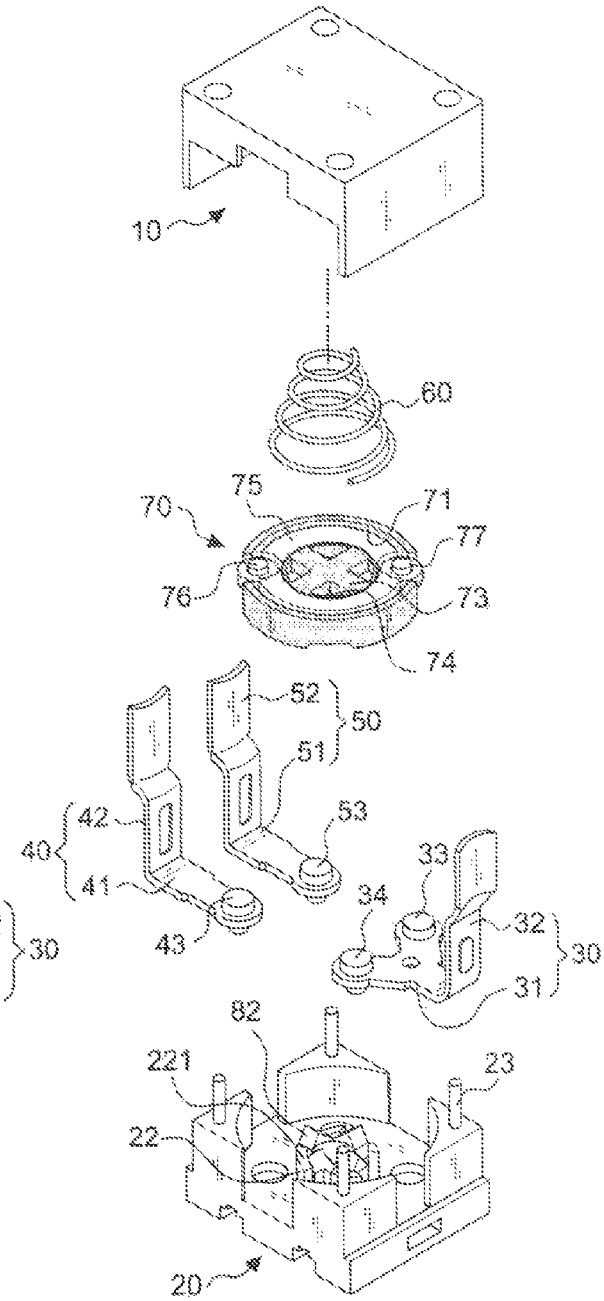
FIG. 2B is an exploded perspective view, illustrating the opposite angle of FIG. 1B.

Referring to FIGS. 1A through 8B, the preferred embodiment of a push button switch in accordance with the present invention comprises a lower housing 10, an upper housing 20, a first terminal 30, a second terminal 40, a third terminal 50, a spring 60, a driven wheel 70, and a driving wheel 80.

The lower housing 10 has a circular recess 11 in the middle thereof and a central post 12 extends perpendicularly away from the center of the circular recess 11.

The upper housing 20 combines with the lower housing 10 to form a housing body and has an axial hole 21 on a top surface thereof. A plurality of position limiting lugs 22 symmetrically arrange around the axial hole 21 at an inner margin surface of the upper housing 20, and each of the position limiting lugs 22 has a guide ramp 221 with the same direction on a bottom margin thereof In this embodiment, the lower housing 10 has a plurality of locating holes 13 and the upper housing 20 correspondingly has a plurality of locating pins 23 for mounting each other.

The first terminal 30 is an L-shaped body and has a transverse portion 31 integrally molded with the upper housing 20, and a vertical portion 32 is exposed at a right side of the upper housing 20. The transverse portion 31 is a Y-shaped body and has a first static contact 33 and a second static contact 34 respectively arranged at the end of the Y-shaped transverse portion 31, and contact surfaces of the first and second static contact 33, 34 face downward and are exposed at the inner margin surface of the upper housing 20.

Figure 3:
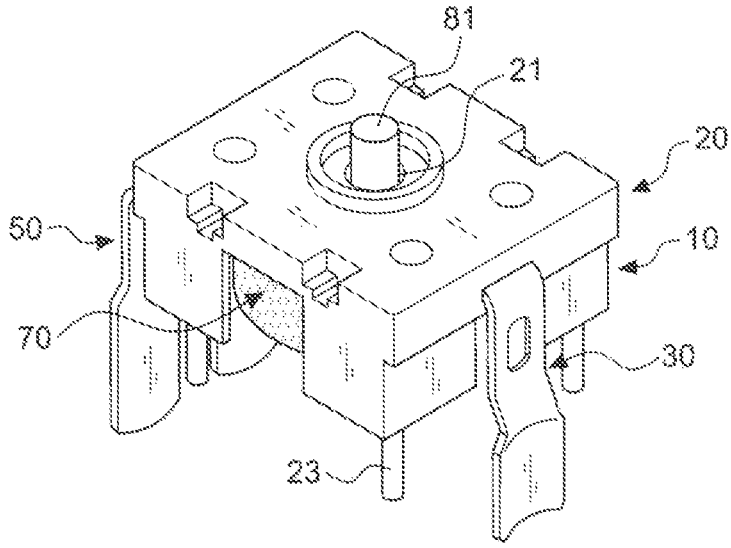
FIG. 3 is a perspective view, illustrating the terminals being integrally molded with an upper housing in accordance with the present invention.
Figure 4:
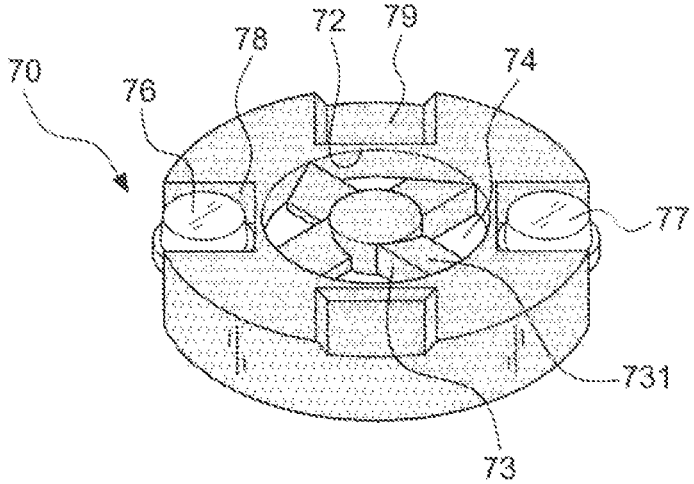
FIG. 4 is a perspective view, illustrating an annular conductive plate being connected with a driving wheel in accordance with the present invention.
Figure 5:
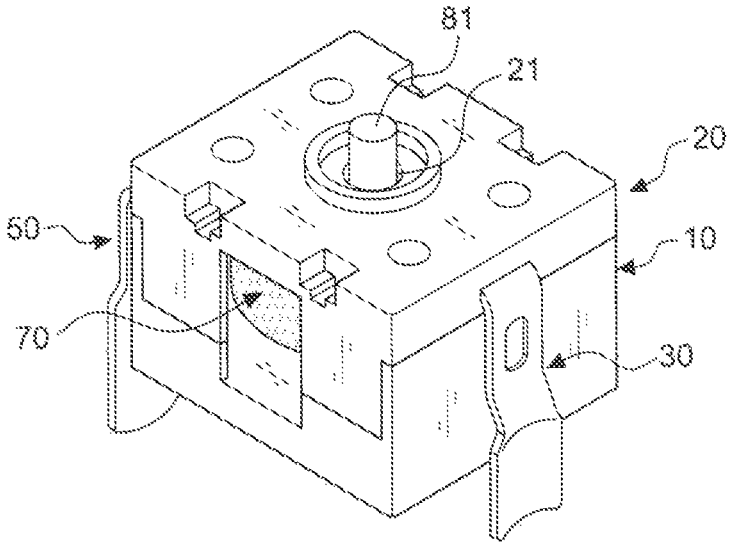
FIG. 5 is a perspective view of the assembly of the present invention.
Figure 6:
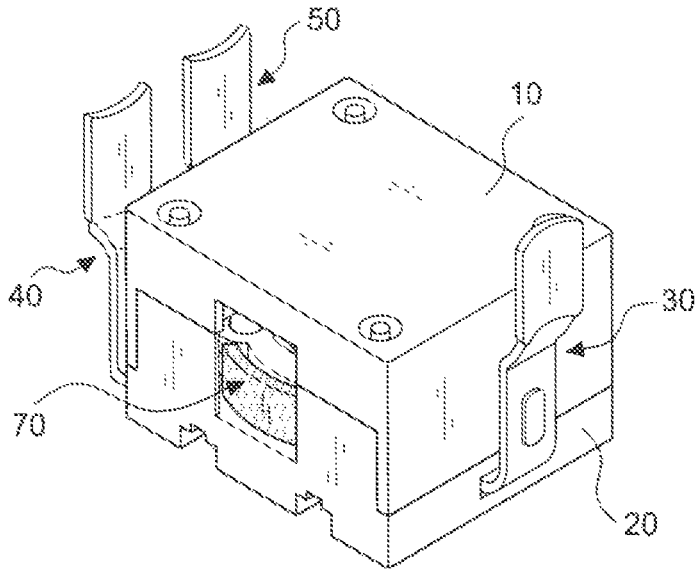
FIG. 6 is a perspective view of another angle of the present invention.

The second terminal 40 and the third terminal 50 are L-shaped bodies and have transverse portions 41, 51 integrally molded with the upper housing 20 and vertical portions 42, 52 are exposed at a left side of the upper housing 20. The transverse portions 41, 51 have a third static contact 43 and a fourth static contact 53 respectively arranged at the end thereof, and contact surfaces of the third static contact 43 and the fourth static contact 53 face downward and are exposed at the inner margin surface of the upper housing 20; such that, the first, second, third, and fourth static contacts 33, 34, 43, 53 are symmetrically exposed at the four end angles of the inner margin surface of the upper housing 20, and a distance between each of the static contacts is equal, With reference to FIGS. 1A to 2B, the first, second, third terminal 30, 40, 50 are in a separating state for easily understanding the structures of the present invention. However, the above-mentioned terminals of the present invention are integrally molded with the upper housing 20 as shown in FIG. 3.

The spring 60 has a bottom end positioned on the central post 12 of the lower housing 10. In this embodiment, the present invention further comprises a washer 61 between a bottom end of the spring 60 and the central post 12.

The driven wheel 70 made of insulating materials positions on a top of the spring 60, and has an annular recess 71 at a bottom surface thereof and a circular hole 72 at a middle of a top surface thereof. The circular hole 72 has a plurality of radial rib bodies 73 to form an axial guide slot 74 between each radial rib body 73 for mounting on the position limiting lug 22 of the upper housing 20, and each of the radial rib bodies 73 has a taper ramp 731 thereon with the same direction. The annular recess 71 has an annular conductive plate 75 therein. The annular conductive plate 75 made of conducting materials has a first movable contact 76 and a second movable contact 77 respectively arranged on a corresponding end of the annular conductive plate 75, and the first and second movable contact 76, 77 corresponding to the first, second, third, and fourth static contacts 33, 34, 43, 53 are exposed at a top surface of the driven wheel 70. In this embodiment, the driven wheel 70 has a notch 78 at two corresponding ends thereof for the first movable contact 76 and second movable contact 77 of the driven wheel 70 exposed at a surface of the driven wheel 70, and a locating recess 79 at other two corresponding ends thereof for locating four static contacts of the upper housing 20; wherein two static contacts on the corresponding end locate on the locating recess 79 and other two corresponding static contacts respectively form an electrical connection with the first movable contact 76 and second movable contact 77.

The driving wheel 80 has an actuator plunger 81 and a plurality of actuator lugs 82 at a bottom end of the actuator plunger 81; wherein the actuator plunger 81 upwardly extends through a bottom surface of the axial hole 21 and is exposed at a top surface of the upper housing 20, and each of the actuator lugs 82 corresponding to the radial rib body 73 of the driven wheel 70 is against a top of the taper ramp 731. In this embodiment, the upper housing 20 has four position limiting lugs 22, and the driven wheel 70 has four corresponding axial guide slots 74 for the driven wheel 70 being rotated once 90°. Further, the driving wheel 80 has four actuator lugs 82. Moreover, the above drive wheel 80, upper housing 20, and lower housing 10 are made of insulating materials. On the other hand, the terminals and the annular conductive plate 75 are made of conducting materials.

Figure 7A:
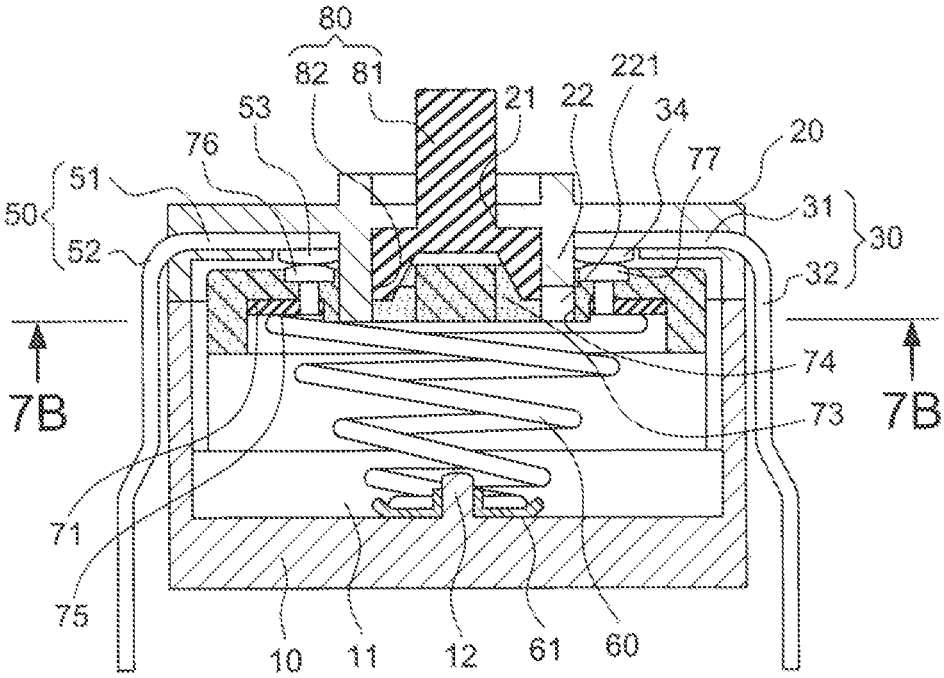
FIG. 7A is a sectional view of the present invention.
Figure 7B:
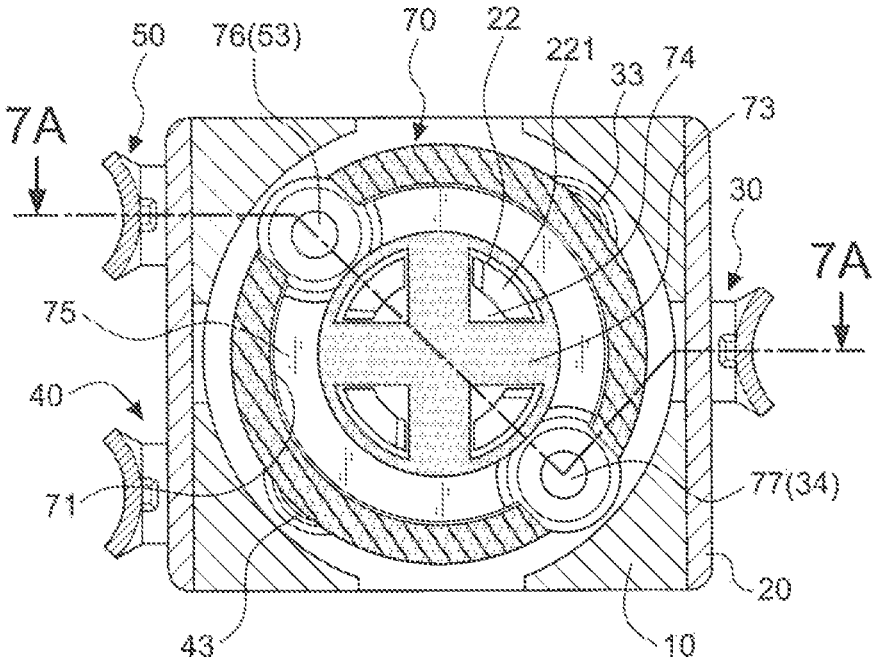
FIG. 7B is a cross-section view of line 7B-7B in FIG. 7A, illustrating the electrical connection between the first terminal and the second terminal.

With the reference to FIGS. 7A to 7B, the first movable contact 76 and second movable contact 77 of the annular conductive plate 75 respectively form an electrical connection with the fourth static contact 53 of the first terminal 50 and the second static contact 34 of the first terminal 30. Therefore, when the actuator plunger 81 of the upper housing 20 is fully depressed, the driven wheel 70 travels downward until the axial guide slot 74 departs from the position limiting lug 22 of the upper housing 20, and the actuator lug 82 of the driving wheel 80 urges the taper ramp 731 of the radial rib body 73 for the driven wheel 70 rotating at an angle; when the actuator plunger 81 of the upper housing 20 is released, the driven wheel 70 is urged upward by the spring 60 and the radial rib body 73 slides along the guide ramp 221 of the position limiting lug 22 of the upper housing 20 into the adjacent position limiting lug 22 for synchronously driving the first and second movable contact 76, 77 of the driven wheel 70 into a 90° rotation; such that, the first movable contact 76 and second movable contact 77 of the annular conductive plate 75 respectively form an electrical connection with the third static contact 43 of the second terminal 40 and the first static contact 30 of the first terminal 30 in order to control the circuit connecting switch.

Base on the features disclosed, the present invention has the following effects:

1. The first, second, and third terminal 30, 40, 50 are 90° L-shaped bodies that the transverse portions 31, 41, 51 and the vertical portions 32, 42, 52 as contact portions are not in a same plate. Moreover, the transverse portions 31, 41, 51 are integrally molded with the upper housing 20 and the first, second, third, and fourth static contact 33, 34, 43, 53 are exposed. Therefore, when the vertical portions of the terminals are deformed by the connection of an external component, the deformation of the terminals will not affect the contact portions. Accordingly, the terminals 30, 40, 50 remain a good electrical connection with the annular conductive plate 75.

Figure 8A:
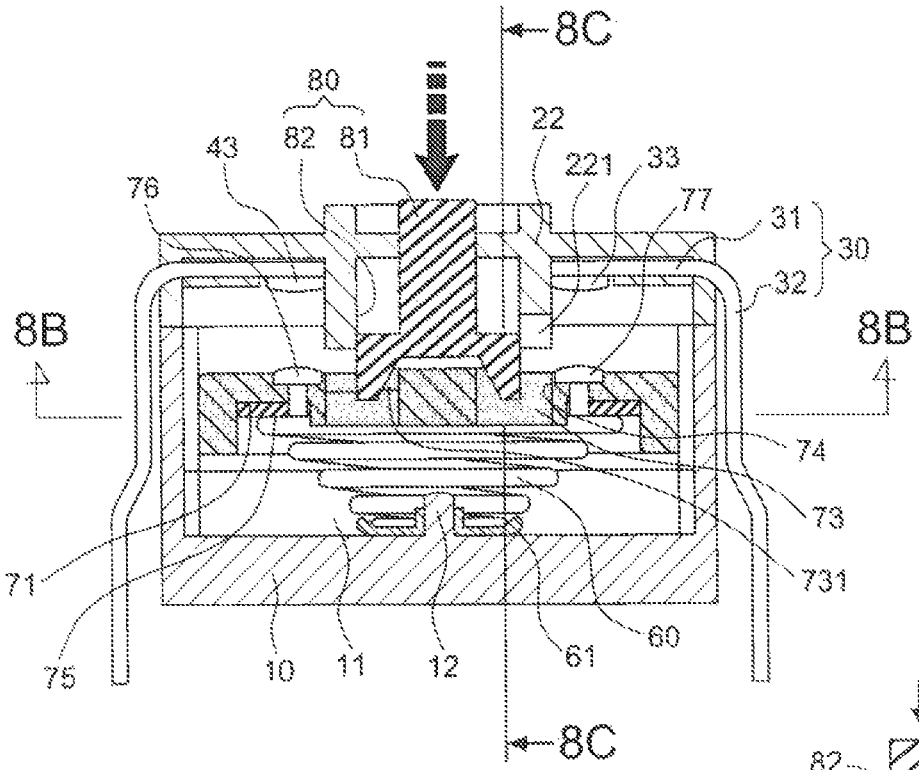
FIG. 8A is a sectional view of the present invention, illustrating the button is depressed.
Figure 8C:
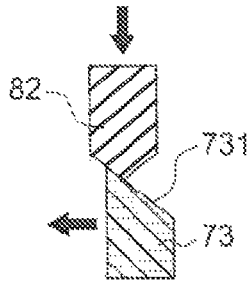
FIG. 8C is a cross-section view of line 8C-8C in FIG. 8A.
Figure 8B:
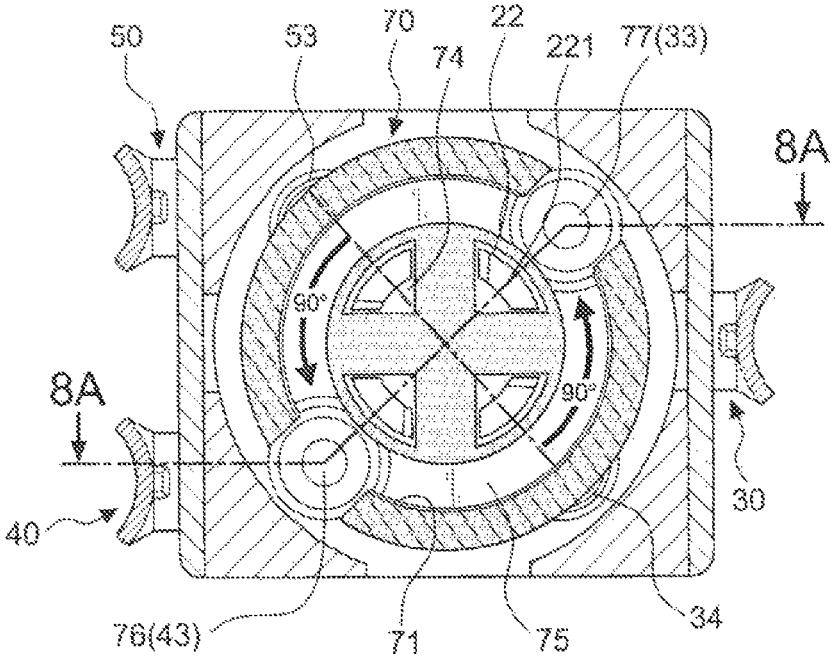
FIG. 8B is a cross-section view of line 8B-8B in FIG. 8A.

2. The first, second, third, and fourth static contact 33, 34, 43, 53 as shown in FIGS. 7A and 7B face downward and the first and second movable contact 76, 77 face upward. With reference to FIGS. 8A to 8C, the annular conductive plate 75 travels downward with the driven wheel 70 until departing from the position limiting lug 22 and rotates at an angle in order to avoid the friction and impact damage between the terminals and the tactics contacts. Accordingly, the switch can smoothly rotate.

3. The annular conductive plate 75 is fixed in the driven wheel 70 instead of the independent metal plate according to the prior art in order to increase the strength of the annular conductive plate 75 and to avoid deformation, so that it rotates smoothly, enhancing the reliability of electrical connection and ensuring its service life.

Although particular embodiments of the invention have been described in detail for purposes of illustration, various modifications and enhancements may be made without departing from the spirit and scope of the invention. Accordingly, the invention is not to he limited except as by the appended claims.

What is claimed is:

1. A push-button switch, comprising:

a) a lower housing having a circular recess in the middle thereof and a central post extending perpendicularly away from the center of the circular recess;

b) an upper housing combining with the lower housing to form a housing body and having an axial hole on a top surface thereof, a plurality of position limiting lugs symmetrically arranged around the axial hole at an inner margin surface of the upper housing, and each of the position limiting lugs having a guide ramp with the same direction on a bottom margin thereof;

c) a first terminal being an L-shaped body and having a transverse portion integrally molded with the upper housing and a vertical portion exposed at a right side of the upper housing, the transverse portion being a Y-shaped body and having a first static contact and a second static contact respectively arranged at ends of the Y-shaped transverse portion, and contact surfaces of the first and second static contact facing downward and exposed at the inner margin surface of the upper housing;

d) a second terminal and third terminal being L-shaped bodies and having transverse portions integrally molded with the upper housing and vertical portions exposed at a left side of the upper housing, the transverse portions having a third static contact and a fourth static contact respectively arranged at ends thereof, and contact surfaces of the third static contact and the fourth static contact facing downward and exposed at the inner margin surface of the upper housing; such that, the first, second, third, and fourth static contacts are symmetrically exposed at the four end angles of the inner margin surface of the upper housing, and a distance between each of the static contacts is equal;

e) a spring having a bottom end positioned on the central post of the lower housing;

f) a driven wheel made of insulating materials, positioned on a top of the spring, and having an annular recess at a bottom surface thereof and a circular hole at a middle of a top surface thereof; the circular hole having a plurality of radial rib bodies to form an axial guide slot between each radial rib body for mounting on the position limiting lugs of the upper housing, each of the radial rib bodies having a taper ramp thereon with the same direction, the annular recess having an annular conductive plate therein and the annular conductive plate being made of conducting materials and having a first movable contact and a second movable contact respectively arranged on a corresponding end of the annular conductive plate, and the first and second movable contacts, corresponding to the first, second, third, and fourth static contacts are exposed at a top surface of the driven wheel; and g) a driving wheel having an actuator plunger and a plurality of actuator lugs at a bottom end of the actuator plunger, wherein the actuator plunger is upwardly extended through a bottom surface of the axial hole and exposed at a top surface of the upper housing, each of the actuator lugs corresponding to the radial rib bodies of the driven wheel are against a top of the taper ramp;

whereby when the actuator plunger of the upper housing is fully depressed, the driven wheel travels downward until the axial guide slot departs from the position limiting lugs of the upper housing, and the actuator lugs of the driving wheel urge the taper ramps of the radial rib bodies for the driven wheel rotating at an angle; when the actuator plunger of the upper housing is released, the driven wheel is urged upward by the spring and the radial rib bodies slide along the guide ramps of the position limiting lugs of the upper housing into the adjacent position limiting lug for synchronously driving the first movable and second movable contact of the driven wheel into a 90° rotation; such that, one of the second terminal and third terminal is electrically connected to the first terminal in order to control the circuit connecting switch.

2. The push-button switch as recited in claim 1, wherein the driven wheel has a notch at two corresponding ends thereof for the first movable contact and second movable contact of the driven wheel exposed at a surface of the driven wheel, and a locating recess at other two corresponding ends thereof for locating four static contacts of the upper housing; wherein two static contacts on the corresponding ends locate on the locating recess and other two corresponding static contacts respectively form an electrical connection with the first movable contact and second movable contact.

3. The push-button switch as recited in claim 1, wherein the upper housing has four position limiting lugs, and the driven wheel has four corresponding axial guide slots for the driven wheel being rotated once 90°.

4. The push-button switch as recited in claim 1, wherein the driving wheel has four actuator lugs.

5. The push-button switch as recited in claim 1, further comprising a washer between a bottom end of the spring and the central post.

6. The push-button switch as recited in claim 1, wherein the lower housing has a plurality of locating holes and the upper housing correspondingly has a plurality of locating pins for mounting each other.

* * * * *